US005937714A

United States Patent [19]

Sherman et al.

[11] Patent Number: 5,937,714

[45] Date of Patent: Aug. 17, 1999

[54] TOOL FOR REMOVING BASES OF BROKEN LIGHT BULBS

[76] Inventors: Shell Steven Sherman; Karen Lee Sherman, both of 632 Valencia Dr., Boulder City, Nev. 89005

[21] Appl. No.: 08/675,193

[22] Filed: Jul. 3, 1996

[51] Int. Cl.[6] ..... B25B 23/00

[52] U.S. Cl. ..... 81/53.1; 81/441

[58] Field of Search ..... 81/441, 53.1, 53.2, 81/64, 53.11; 30/103, 166.3, 355

[56] References Cited

U.S. PATENT DOCUMENTS

| | | | |
|---|---|---|---|
| 1,319,028 | 10/1919 | Grinnell | 81/441 |
| 1,493,762 | 5/1924 | Mannion et al. | 81/441 |
| 1,899,489 | 2/1933 | Wickbergh | 81/441 |
| 2,106,741 | 2/1938 | Herbert | 81/441 |
| 3,797,055 | 3/1974 | Greene | 81/441 |
| 3,898,896 | 8/1975 | Suhay | 81/441 |
| 4,485,701 | 12/1984 | Hough | 81/64 |
| 5,103,695 | 4/1992 | Dolle et al. | 81/441 |
| 5,458,026 | 10/1995 | Southard et al. | 81/441 |

*Primary Examiner*—D. S. Meislin

*Attorney, Agent, or Firm*—Patent & Trademark Services; Joseph H. McGlynn

[57] ABSTRACT

An improved tool for extracting the base of a broken light bulb from a socket. An integral device has a cylindrical stem portion with an enlarged handle at one end and a tapered conical portion with a flat tip at the other. The tapered conical portion has toothed blade members embedded in slots thereon, with the toothed edges facing outward. Two such blades are longitudinally disposed at diametrically opposed locations of the conical portion, and a shorter blade member is horizontally disposed on the flat tip thereof.

6 Claims, 1 Drawing Sheet

TOOL FOR REMOVING BASES OF BROKEN LIGHT BULBS

BACKGROUND OF THE INVENTION

The present invention relates generally to tools for removing the base of a broken light bulb from a socket, and in particular to a light bulb base remover having a tapered conical extraction implement with flexible, toothed blades, providing safe and easy extraction without binding up or damaging the socket.

DESCRIPTION OF THE PRIOR ART

A common problem encountered with light bulbs is their tendency to break away from the base during the process of removing them from the socket. The base cannot then be removed by hand, due to the danger of injury and the futility of attempting to grasp the base with the fingers. A number of devices have been disclosed in the prior art in an attempt to address this problem.

U.S. Pat. No. 3,797,055, for example, discloses a cylindrical tool having a conical end member with radial flanges for insertion into a socket for the purpose of removing a light bulb base. An obvious drawback of this invention, however, is that the end member, constructed of rigid metal, tends to distort the soft metal of the light bulb base, causing it to bind up in the socket. This invention can, for the same reason, cause damage to the socket itself. Moreover, use of this invention by the unwary invites electrical shock, because it is made of metal and therefore will conduct electricity to the user's body if the light switch is accidentally left on.

U.S. Pat. No. 5,458,026 suffers from a similar disadvantage. This invention comprises a cylindrical tool member having a plurality of rigid, sharpened pins at one end. These pins, especially if inserted into an ill-fitting socket, can cause damage to the bulb base and socket, making extraction difficult or impossible. This invention is also composed of a plurality of separate parts, which are inconvenient to use and easy to lose.

U.S. Pat. No. 3,898,896 discloses a tool for extracting the base of a light bulb which has a plurality of rigid knife-type blades which pivot downwardly and radially outward at one end. Aside from the probability that the blades will damage the bulb base and socket, this invention suffers from the additional drawback that the blades themselves are likely to break off or become chipped.

U.S. Pat. No. 5,103,695 describes a tool assembly for performing various tasks associated with light bulbs. This invention, comprising a plurality of hollow, cylindrical, rubber cups, is not likely to provide sufficient rigidity for removing a bulb base that is particularly tight or corroded in the socket.

Clearly, there remains a need for a tool which alleviates these disadvantages. Additionally, there remains a need for a tool which is simple and inexpensive to construct, and which is able to accommodate a variety of different size light sockets. For reasons described in detail below, the present invention satisfies these needs.

SUMMARY OF THE INVENTION

The present invention is an improved tool for extracting the base of a broken light bulb from a socket. The invention comprises an integral device, having a cylindrical body member with an enlarged handle portion at one end and a tapered conical portion with a flat tip at the other end. Embedded into the conical portion are toothed blade members, constructed from semi-flexible metal material similar to that used for constructing hacksaw blades. Two or more such blades are longitudinally disposed on the tapered surface of the conical portion at diametrically opposed locations, and at least one short blade member is horizontally disposed on the flat tip portion thereof.

The conical portion may be inserted into a light socket for the purpose of removing a light bulb base therefrom. The toothed blade members provide a secure grip on the light base, while also providing sufficient flexibility to avoid damage to the light base or the socket. Due to their sturdy yet flexible construction, breakage of the blades themselves is also avoided. Additionally, the tool may be used for a variety of different sized sockets, because the tapered conical portion can be only partially inserted for smaller sockets, and more deeply inserted for larger ones.

The present invention can be inexpensively manufactured. Suitable materials for the construction of the invention include hard plastic, hard rubber, or some similar material. It is important that the material used be dielectric to avoid the risk of electric shock. As noted above, the blade members should be of semi-flexible steel construction, having approximately the same thickness as a medium gauge hacksaw blade.

Accordingly, it is an object of this invention to provide an improved light bulb base extraction tool.

It is a further object of this invention to provide an improved bulb base extraction tool that is durably constructed, inexpensive to make, and simple to use.

It is also an object of this invention to provide an improved bulb base extraction tool that avoids damage to the electrical sockets and distortion of light bulb bases.

It is a further object of this invention to provide an improved light bulb base extraction tool which avoids the risk of electric shock to the user.

Still another object of this invention is to provide an improved light bulb base extraction tool which can be used on a variety of differently sized light sockets.

It is yet a further object of this invention to provide an improved light bulb base extraction tool of unitary construction, having at one end an enlarged handle portion, and at the other end a tapered conical extraction portion with flexible, toothed blades mounted thereon.

These and other objects and advantages of the present invention will become fully apparent from the detailed description below, when taken in conjunction with the annexed drawings.

DESCRIPTION OF THE PREFERRED EMBODIMENT

Figure 1:
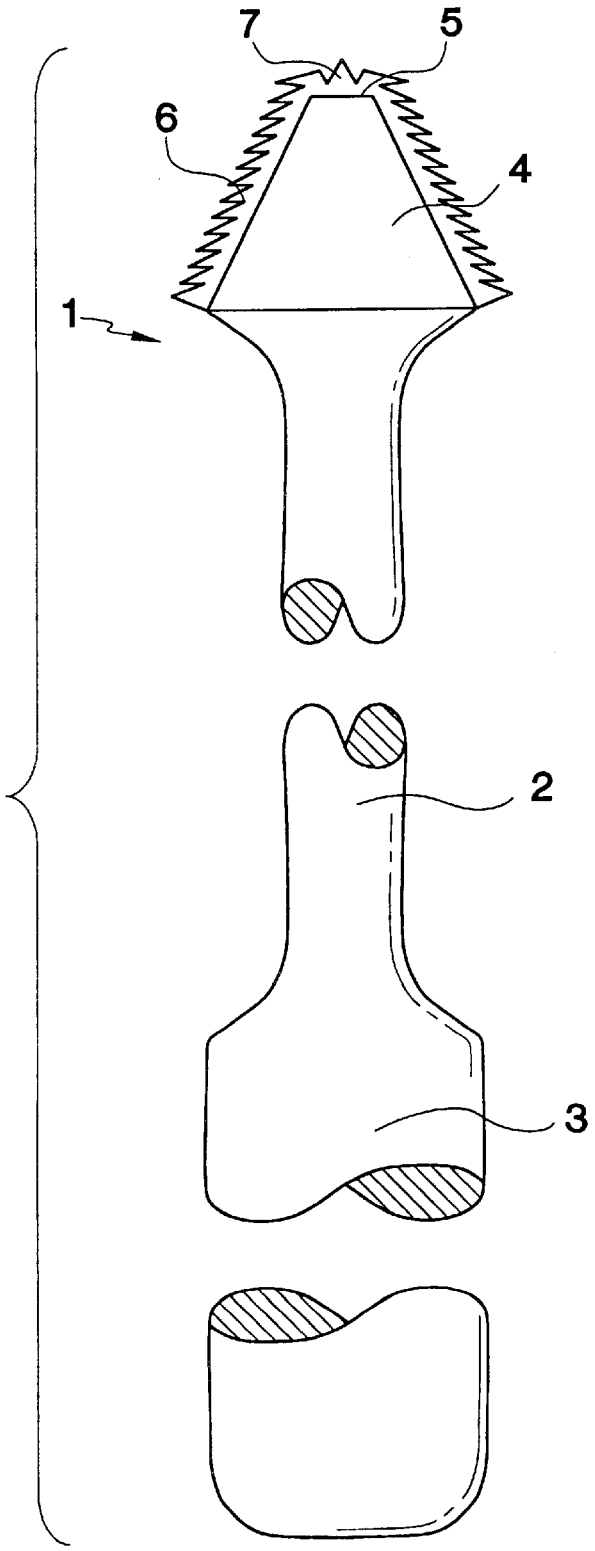
FIG. 1 shows a fragmentary, side elevational view of the present invention.

Referring now to the drawings in greater detail, it can be seen in FIG. 1 that the invention 1 is an integral device having a middle cylindrical stem portion 2, an enlarged lower handle portion 3, and a tapered conical end 4. The conical end 4 has a flattened upper tip 5. Disposed on the conical end 4 are toothed blade members 6, 7. Two such blade members 6 are positioned longitudinally on the conical end 4 at diametrically opposed locations of the surface thereof, and a short blade member 7 is horizontally disposed along the flat tip 5. The blade members 6, 7 can be a unitary member as shown in FIG. 1, or it can be three different blade members: two for the sides of the conical end 4 and one for the tip 5.

Figure 2:
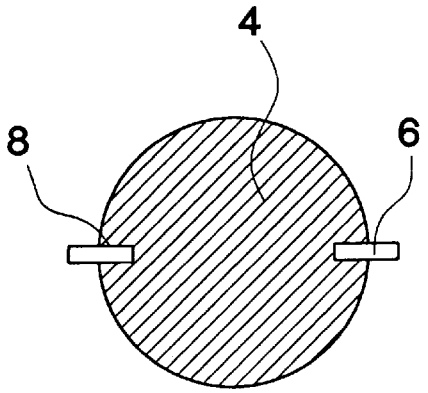
FIG. 2 shows a cross sectional view of the tapered conical end portion of the present invention.

The preferred attachment of the blade members 6 is shown in FIG. 2, giving a cross sectional view of the conical end 4. As seen in FIG. 2, the blade members 6 are embedded into slots 8 on the surface of the conical end 4. These slots 8 are of such width that the blade members 6 are held securely therein, but also such that the blade members 6 can be pulled from the slots 8 easily with pliers when replacement is desirable. Though not shown in cross section, the short blade member 7 on the flat tip 5 of the conical portion 4 is embedded in identical fashion as the longitudinally disposed blade members 6.

The blade members 6, 7 are preferably constructed from thin, flexible steel similar to that used for making hacksaw blades. The blade members have toothed projections which provide traction to grip the interior surface of a light bulb base.

Suitable materials for the construction of the handle component of the invention 1, comprising the cylindrical stem 2, enlarged handle portion 3, and the tapered conical end 4, include hard rubber, plastic, or any similar, durable material. Though various materials will suffice, it is important that the material chosen is dielectric to avoid the risk of electric shock. Often, a person may forget to turn off the light switch before attempting to remove a light bulb base, and insertion of an electrically conductive device can, therefore, be hazardous.

The dimensions of the present invention 1 may vary without departing from the scope of the invention. The invention 1 could be produced as a hand-held, screwdriver sized version, or as a longer adaptation to reach light sockets in out-of-reach locations. The conical end 4 could be produced in a variety of diameters, but ideally would be sized to fit most standard light sockets.

To use the invention 1, the conical end 4 is inserted into the base of a light bulb which has broken off in its socket. A slight upward pressure is applied to the enlarged handle portion 3 to frictionally engage the teeth of the blade members 6, 7 with the internal portion of the light bulb base. The enlarged handle portion 3 is turned, thereby loosening the bulb base from the socket. The flexible construction of the blade members 6, 7 avoids distortion and binding of the light bulb base, as well as damage to the socket itself. Additionally, the blade members 6, 7 themselves are not apt to break when pressure is applied.

Although the light bulb base remover and the method of using the same according to the present invention have been described in the foregoing specification with considerable detail, it is to be understood that modifications to the present invention may be made which do not exceed the scope of the appended claims and modified forms done by others skilled in the art to which the invention pertains will be considered infringements of this invention when those modified forms fall within the claimed scope of the invention.

What I claim as my invention is:

1. A light bulb base extraction tool for extracting light bulb bases from a socket when the lamp bulb has broken comprising:

a body having handle means on a first end and extraction means for removing a broken bulb base on an opposite end, said extraction means comprising a head section having sides and a tip, flexible blade means secured to at least said sides of said head section, said flexible blade means having a first end adjacent said handle means and a second end remote from said handle means, said blade means having a plurality of teeth unitary therewith, said plurality of teeth extending in a longitudinal line from said second end of said flexible blade means towards said first end of said flexible blade means, each of said plurality of teeth having a top side and a bottom side, said top side of each of said plurality of teeth being tapered from said second end of said flexible blade means towards said first end of said flexible blade means.

2. The light bulb base extraction tool for extracting light bulb bases from a socket when the lamp bulb has broken as claimed in claim 1, wherein said blade means is also attached to said tip.

3. The light bulb base extraction tool for extracting light bulb bases from a socket when the lamp bulb has broken as claimed in claim 1, wherein said blade means is a unitary element.

4. The light bulb base extraction tool for extracting light bulb bases from a socket when the lamp bulb has broken as claimed in claim 1, wherein said blade means is inserted within a slot in said head section by means of a friction fit between said blade means and said slot.

5. The light bulb base extraction tool for extracting light bulb bases from a socket when the lamp bulb has broken as claimed in claim 1, wherein said head section is tapered with the largest part adjacent said handle.

6. The light bulb base extraction tool for extracting light bulb bases from a socket when the lamp bulb has broken as claimed in claim 1, wherein said tip is flat.

* * * * *